US010908543B2

(12) United States Patent
Inoue

(10) Patent No.: US 10,908,543 B2
(45) Date of Patent: Feb. 2, 2021

(54) IMAGE FORMING APPARATUS THAT FORMS SEE-THROUGH PREVENTION IMAGE ON RECORDING MEDIUM ON OPPOSITE SIDE OF SOURCE DOCUMENT IMAGE

(71) Applicant: KYOCERA Document Solutions Inc., Osaka (JP)

(72) Inventor: Yasufumi Inoue, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/887,022

(22) Filed: May 29, 2020

(65) Prior Publication Data

US 2020/0379391 A1 Dec. 3, 2020

(30) Foreign Application Priority Data

May 31, 2019 (JP) ..... 2019-103315

(51) Int. Cl.
*G03G 15/00* (2006.01)

(52) U.S. Cl.
CPC ..... *G03G 15/5016* (2013.01)

(58) Field of Classification Search
CPC ..... G03G 15/5016; G03G 15/5062; G03G 2215/00299; G03G 2215/00932
USPC ..... 399/75–77, 81, 407, 408
See application file for complete search history.

(56) References Cited

U.S. PATENT DOCUMENTS 8,395,832 B2 * 3/2013 Iwamoto ..... G06T 5/40 358/518
8,422,067 B2 * 4/2013 Nishimachi ..... G03G 21/046 358/1.18
9,578,206 B2 * 2/2017 Noda ..... H04N 1/4095
2009/0110290 A1 4/2009 Nishimachi

FOREIGN PATENT DOCUMENTS

JP 2009-105843 A 5/2009
JP 2009-182850 A 8/2009

* cited by examiner

*Primary Examiner* — Hoan H Tran
(74) *Attorney, Agent, or Firm* — IP Business Solutions, LLC

(57) ABSTRACT

An image forming apparatus includes an input device, an image forming device, and a control device. The control device includes a processor, and acts, when the processor executes a control program, as a controller that, upon receipt of an instruction to form a source document image on a first face of a plurality of recording media through the input device, causes the image forming device to form the source document image on the first face of the plurality of recording media, designates a recording medium on which a see-through prevention image, constituted of a predetermined pattern, is to be formed, out of the plurality of recording media, and causes the image forming device to form the see-through prevention image only on a second face, opposite to the first face, of the recording medium designated.

7 Claims, 10 Drawing Sheets

Fig.3

| ILLUMINATION COLOR | SEE-THROUGH PREVENTION PATTERN |
|---|---|
| DAYLIGHT COLOR | 32 |
| NEUTRAL WHITE | 34 |
| INCANDESCENT LIGHT BULB COLOR | 36 |

IMAGE FORMING APPARATUS THAT FORMS SEE-THROUGH PREVENTION IMAGE ON RECORDING MEDIUM ON OPPOSITE SIDE OF SOURCE DOCUMENT IMAGE

INCORPORATION BY REFERENCE

This application claims priority to Japanese Patent Application No. 2019-103315 filed on May 31, 2019, the entire contents of which are incorporated by reference herein.

BACKGROUND

The present disclosure relates to an image forming apparatus, and in particular to a technique to form a see-through prevention image.

Some techniques have been developed, to print a see-through prevention image, to make a source document image printed on a recording sheet difficult to be seen through, from the opposite side thereof.

For example, a first technique is known that includes recognizing a character region, a picture region, and a background region in image data generated from a source document, and printing a see-through prevention pattern determined on the basis of the type of the recognized regions, on the back face of the recording sheet having the source document image printed on the front face thereof, on the regions respectively corresponding to the recognized regions.

In addition, a second technique is known that includes printing the source document image on a first recording sheet, printing the see-through prevention pattern determined according to the first technique, on a second recording sheet on the regions respectively corresponding to the recognized regions, and binding the first and second recording sheets together, such that the face of the first recording sheet on which the source document image is printed, and the face of the second recording sheet on which the see-through prevention pattern is printed, are opposed to each other.

SUMMARY

The disclosure proposes further improvement of the foregoing technique.

In an aspect, the disclosure provides an image forming apparatus including an input device, an image forming device, and a control device. The input device is for inputting an instruction of a user. The image forming device forms an image on a recording medium. The control device includes a processor, and acts, when the processor executes a control program, as a controller that, upon receipt of an instruction to form a source document image on a first face of a plurality of recording media through the input device, causes the image forming device to form the source document image on the first face of the plurality of recording media, designates a recording medium on which a see-through prevention image, constituted of a predetermined pattern, is to be formed, out of the plurality of recording media, and causes the image forming device to form the see-through prevention image only on a second face, opposite to the first face, of the recording medium designated.

BRIEF DESCRIPTION OF THE DRAWINGS

FIG. 3 is a table showing an example of recommended pattern information.

DETAILED DESCRIPTION

Figure 1:
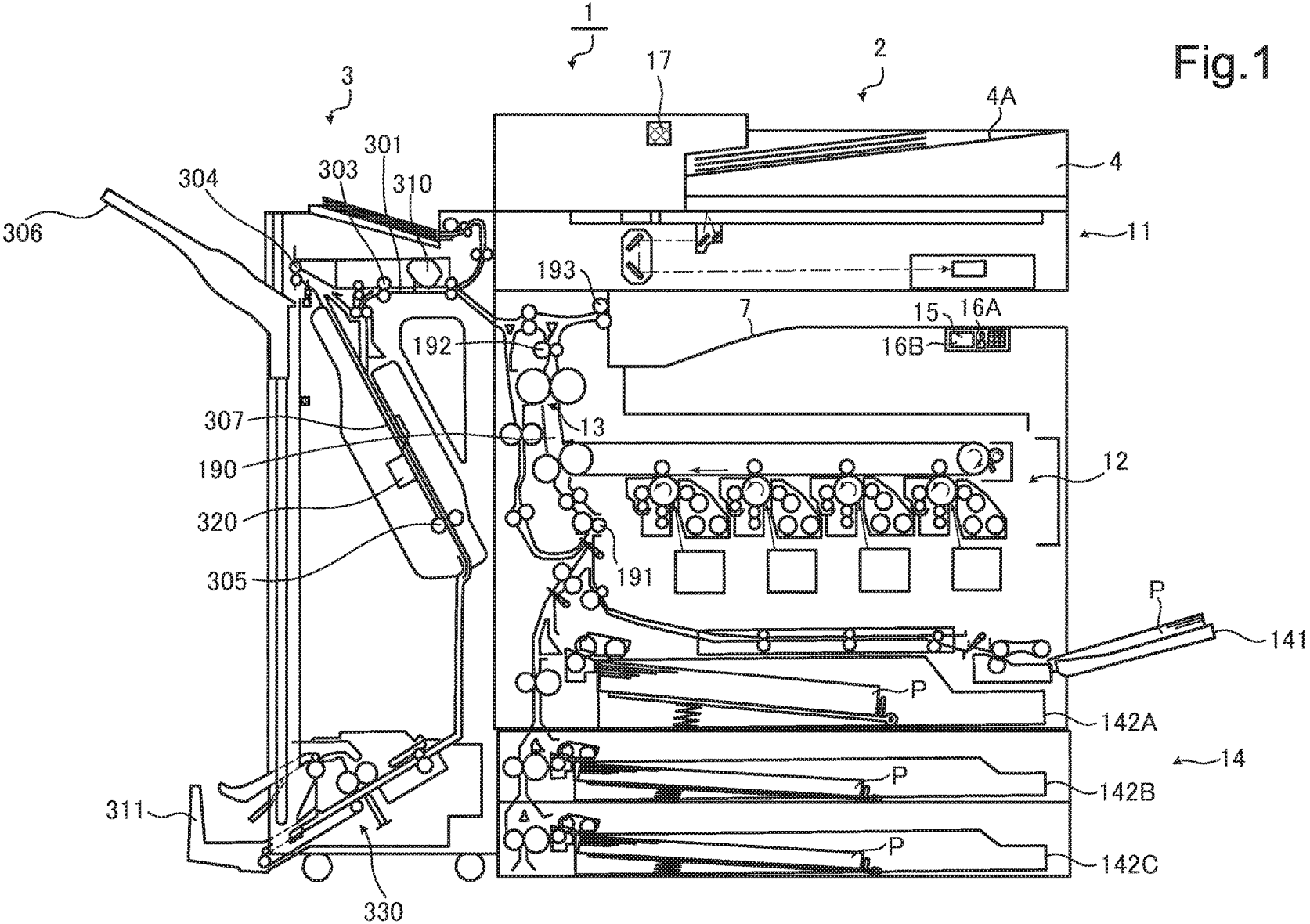
FIG. 1 is a front cross-sectional view showing a configuration of an image forming apparatus according to an embodiment of the disclosure.
Figure 2:
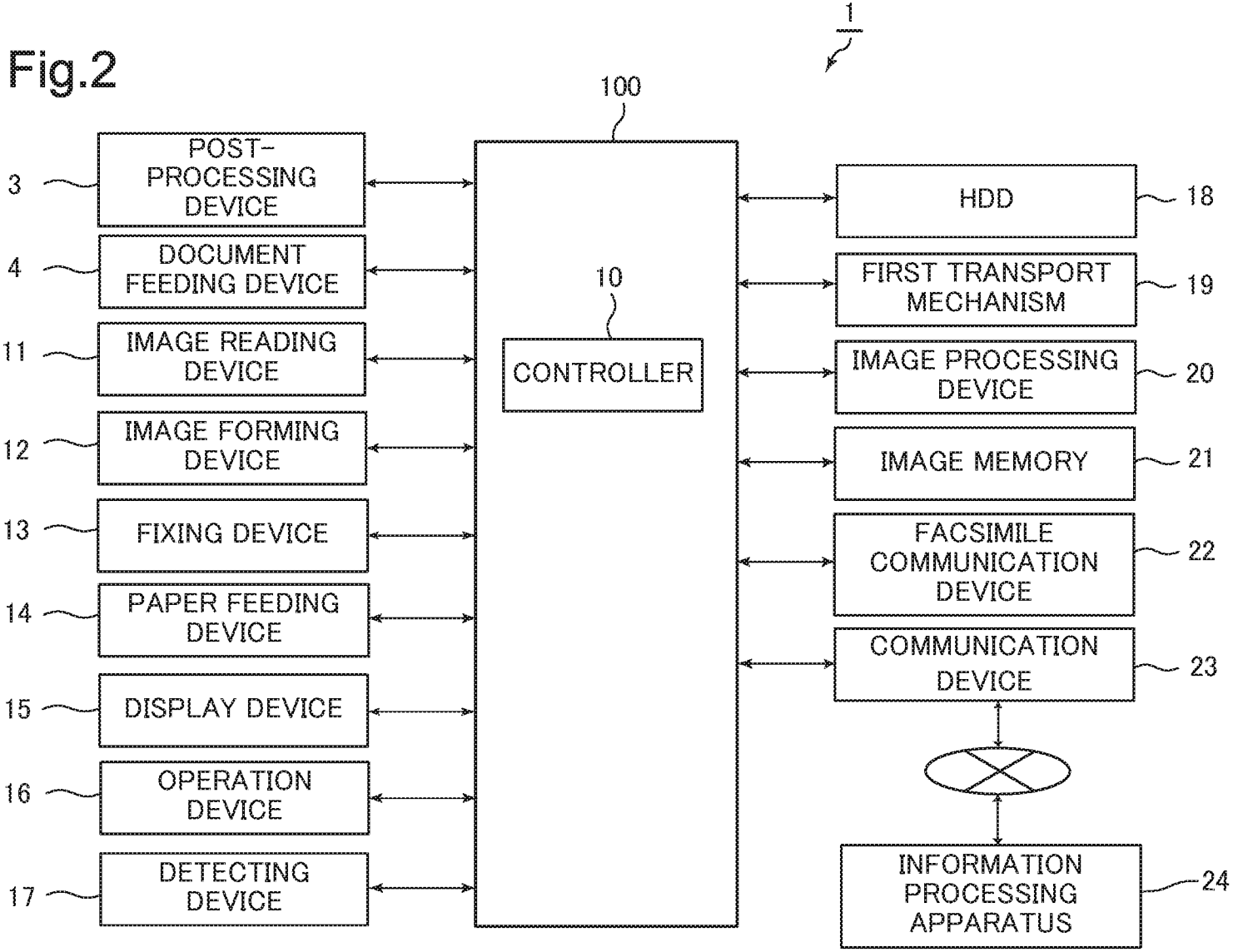
FIG. 2 is a block diagram showing an internal configuration of the image forming apparatus.

Hereafter, an image forming apparatus according to an embodiment of the disclosure will be described, with reference to the drawings. FIG. 1 is a front cross-sectional view showing a configuration of the image forming apparatus according to the embodiment of the disclosure. FIG. 2 is a block diagram showing an internal configuration of the image forming apparatus.

Referring to FIG. 1, the image forming apparatus 1 includes a main body 2 and a post-processing device 3. Hereunder, the configuration of the main body 2 and the post-processing device 3 will be described.

Configuration of Main Body 2

The main body 2 has a plurality of functions such as facsimile communication, copying, printing, and scanning. The main body 2 includes an image reading device 11, an image forming device 12, a fixing device 13, a paper feeding device 14, a display device 15, an operation device 16, and a detecting device 17.

The image reading device 11 includes an automatic document feeder (ADF), having a document feeding device 4 that transports a source document placed on a document table 4A, and a scanner that optically reads the source document transported by the document feeding device 4, or placed on a platen glass. The image reading device 11 emits light to the source document from a light emitter, and receives the reflected light with a charge-coupled device (CCD) sensor, to thereby read the source document and generate image data.

The image forming device 12 includes a photoconductor drum, a charging device, an exposure device, a developing device, and a transfer device. The image forming device 12 forms a toner image on a recording sheet P delivered from the paper feeding device 14, on the basis of the image data generated by the image reading device 11.

The fixing device 13 heats and presses the recording sheet P on which the toner image has been formed by the image forming device 12, to thereby fix the toner image on the recording sheet P After the fixing, the recording sheet P having the toner image fixed thereon by the fixing device 13 is discharged to a first output tray 7, or transported toward the post-processing device 3.

The paper feeding device 14 includes a manual bypass tray 141, and paper cassettes 142A to 142C. The paper feeding device 14 draws out one by one the recording sheets P stored in one of the paper cassettes 142A to 142C, or placed on the manual bypass tray 141, and feeds the recording sheets P to the image forming device 12.

The display device 15 is constituted of, for example, an LCD. The display device 15 displays various types of screens related to the functions that the image forming apparatus 1 is configured to perform.

The operation device 16 includes a plurality of hard keys, such as a start key 16A for instructing the start of various operations. The operation device 16 also includes a touch panel 16B overlaid on the display device 15. The user inputs various types of information, such as the instruction related to the functions that the image forming apparatus 1 is configured to perform, through the operation device 16. The operation device 16 exemplifies the input device in What is claimed is.

The detecting device 17 detects an illumination color around the image forming apparatus 1. Although the type of the detecting device 17 is not specifically limited, an illuminance color meter that detects the illumination color as a correlated color temperature may be employed as the detecting device 17, in this embodiment.

Referring to FIG. 2, the main body 2 includes a control device 100. The control device 100 includes a processor, a random-access memory (RAM), and a read-only memory (ROM). The processor is, for example, a central processing device (CPU), a micro processing device (MPU), or an application specific integrated circuit (ASIC).

The control device 100 acts as a controller 10, when the processor executes a control program stored in a built-in ROM or hard disk drive (HDD) 18. Here, the controller 10 may be constituted in the form of a hardware circuit, instead of being realized by the operation according to the control program.

The control device 100 is electrically connected to the post-processing device 3, the document feeding device 4, the image reading device 11, the image forming device 12, the fixing device 13, the paper feeding device 14, the display device 15, the operation device 16, the detecting device 17, the HDD 18, a first transport mechanism 19, an image processing device 20, an image memory 21, a facsimile communication device 22, and a communication device 23.

The first transport mechanism 19 includes transport roller pairs 191 and 192, and a discharge roller pair 193. The first transport mechanism 19 transports, under the control of the controller 10, the recording sheet P to the first output tray 7 along the transport route 190, when the first output tray 7 is selected as the destination, and discharges the recording sheet P to the first output tray 7. When the post-processing device 3 is scheduled to perform post-processing, the first transport mechanism 19 transports the recording sheet P along the transport route 190, and delivers the recording sheet P to the post-processing device 3, under the control of the controller 10.

The controller 10 controls the overall operation of the image forming apparatus 1. To be more detailed, the controller 10 controls the operation of each of the components of the image forming apparatus 1, and also makes communication with an information processing apparatus 24 such as a personal computer, connected via a network.

The HDD 18 is a large-capacity storage device for storing various types of data, including the image data generated by the image reading device 11. The HDD 18 contains various control programs to be used to realize basic operations of the image forming apparatus 1. One of the control programs stored in the HDD 18 is the control program for performing the image forming operation, according to the embodiment of the disclosure. The HDD 18 exemplifies the storage device in What is claimed is.

In the HDD 18, illumination color information indicating values of the color temperature, and illumination colors respectively associated therewith, is stored in advance. Here, it will be assumed that the HDD 18 stores therein the color temperature value in a range from 5700 K to 7100 K and "daylight color" in association with each other, the color temperature value in a range from 4600 K to 5500 K and "neutral white" in association with each other, and the color temperature value in a range from 2600 K to 3250 K and "incandescent light bulb color" in association with each other.

The HDD 18 also stores therein the illumination colors and recommended patterns in association with each other, as recommended pattern information, the recommended pattern being a pattern recommended for constituting the see-through prevention image, with respect to each of the illumination colors. FIG. 3 is a table showing an example of the recommended pattern information. Referring to FIG. 3, the "daylight color" is associated with a first pattern 32, the "neutral white" is associated with a second pattern 34, and the "incandescent light bulb color" is associated with a third pattern 36, in the HDD 18.

Under the illumination of the daylight color, the source document image formed on the front face of the recording sheet P is most easily seen through from the back of the recording sheet P, among the three illumination colors cited above. Accordingly, an image that consumes a largest amount of toner is selected for the first pattern 32, among the three patterns cited above, to make the source document image difficult to be seen through, under the illumination of the daylight color. Although the design of the first pattern 32 is not specifically limited, an image blotted out in a solid color is selected as the first pattern 32, in this embodiment.

Under the illumination of the neutral white, the source document image formed on the front face of the recording sheet P is second easiest to be seen through from the back of the recording sheet P, among the three illumination colors cited above. Accordingly, an image that consumes a second largest amount of toner is selected for the second pattern 34, among the three patterns cited above, to make the source document image difficult to be seen through, under the illumination of the neutral white. Although the design of the second pattern 34 is not specifically limited, an image composed of a plurality of lines, each extending in a first predetermined direction, is selected as the second pattern 34, in this embodiment. The plurality of lines of the second pattern 34 are aligned at regular intervals in a second direction orthogonal to the first direction.

Under the illumination of the incandescent light bulb color, the source document image formed on the front face of the recording sheet P is most difficult to be seen through from the back of the recording sheet P, among the three illumination colors cited above. Accordingly, an image that consumes a least amount of toner is selected for the third pattern 36, among the three patterns cited above, to make the source document image difficult to be seen through, under the illumination of the incandescent light bulb color. Although the design of the third pattern 36 is not specifically limited, an image composed of a plurality of dots, arranged in the first and second direction at regular intervals, is selected as the third pattern 36, in this embodiment.

The image processing device 20 performs, if need be, image processing with respect to the image data generated by the image reading device 11.

The image memory 21 includes a region for temporarily storing the image data, generated by the image reading device 11 and representing the image to be formed.

The facsimile communication device 22 makes connection to the public telephone network, to transmit and receive the image data through the public telephone network.

The communication device 23 includes a communication module such as a local area network (LAN) board. The main body 2 performs data communication through the communication device 23, with the information processing apparatus 24 such as a personal computer, connected via a network.

A power source is provided for each of the components in the main body 2, so that the components of the main body 2 and the post-processing device 3 perform the operation, with the power from the power source.

Configuration of Post-Processing Device 3

The post-processing device 3 is an optional device removably mounted on the main body 2. The post-processing device 3 includes a second transport mechanism for transporting the recording sheet P, a perforator 310 for forming a punched hole in the recording sheet P, a binding device 320 for binding a plurality of recording sheets, and a folding device 330 for folding the recording sheet P. The mentioned components of the post-processing device 3 each operate under the control of the controller 10 in the main body 2.

The second transport mechanism includes transport roller pairs 303 and 305, and a discharge roller pair 304. The second transport mechanism is configured to transport the recording sheet P along a transport route 301, to a second output tray 306 or a third output tray 311, whichever is selected as the destination.

When the punching operation is scheduled as the post-processing, the perforator 310 forms a punched hole at a predetermined position on the recording sheet P transported along the transport route 301. When the scheduled post-processing only includes the punching, the second transport mechanism transports the recording sheet P, having the punched hole formed therein, toward the second output tray 306, and discharges the recording sheet P thereto.

When at least one of the binding and folding operations is scheduled as the post-processing, the second transport mechanism transports the recording sheet P having the punched hole formed therein, or the recording sheet P that has passed the perforator 310 without undergoing the punching operation, toward the processing tray 307. When the binding operation is scheduled as the post-processing, a plurality of recording sheets P transported toward the processing tray 307 are temporarily accumulated thereon, with the respective leading edges aligned with each other.

The binding device 320 performs an edge binding operation to bind the edge portion of the plurality of recording sheets P stacked on the processing tray 307, or a center binding operation to bind the central portion of the plurality of recording sheets P. The type of the binding device 320 is not specifically limited but, for example, a stapler may be employed. When the folding operation is not scheduled as the post-processing, the second transport mechanism transports the bundle of the recording sheets P that have undergone the binding operation toward the second output tray 306, and discharges the bundle of the recording sheets P thereto.

When the folding operation is scheduled as the post-processing, the second transport mechanism transports the bundle of the recording sheets P that have undergone the binding operation, or the recording sheets P that have passed the binding device 320 without undergoing the binding operation, toward the folding device 330. The folding device 330 folds the bundle of the recording sheets P, or the loose recording sheets P, transported by the second transport mechanism. The second transport mechanism discharges the folded bundle of the recording sheets P or each of the recording sheets P folded, to the third output tray 311.

Operation

Figure 4A:
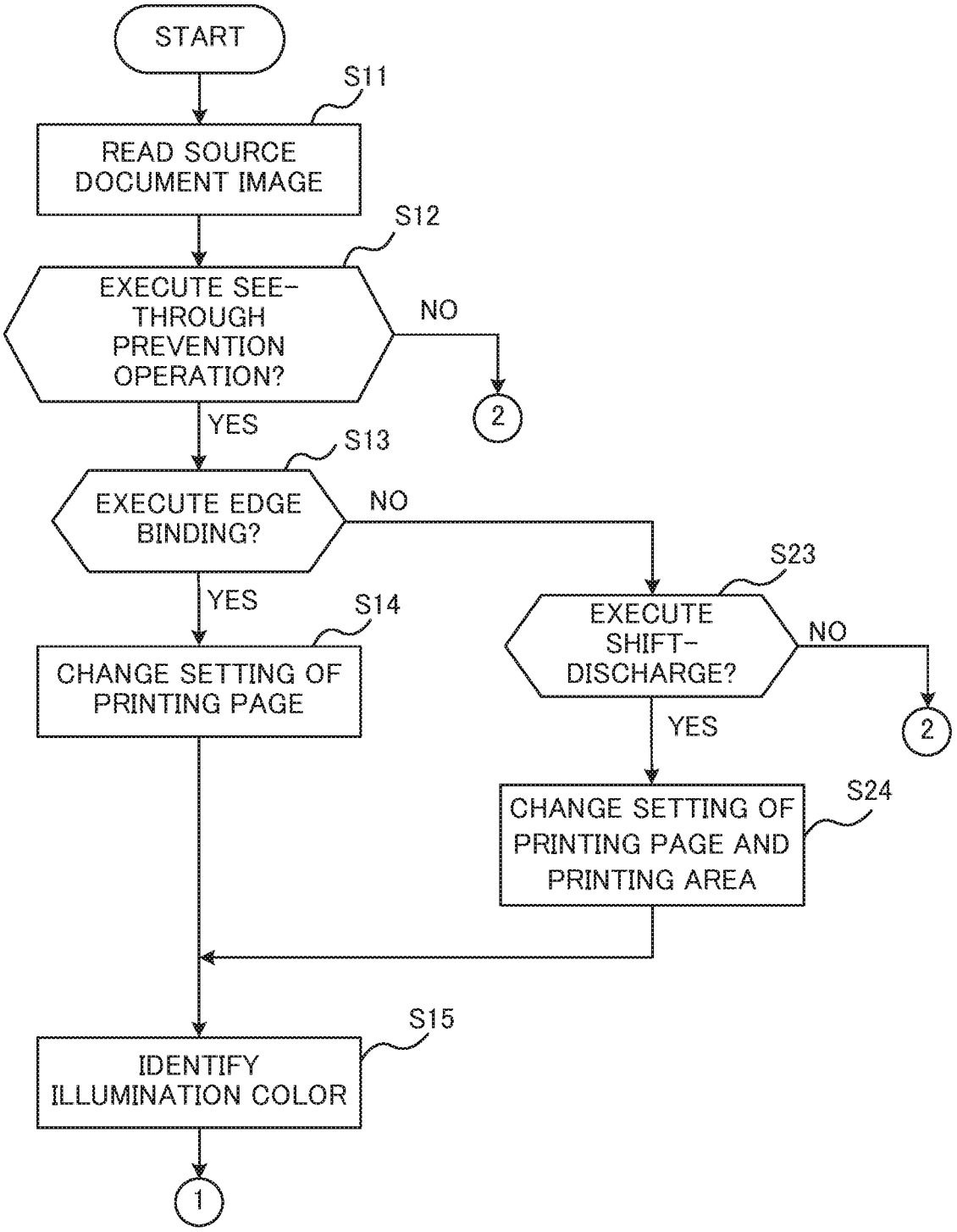
FIG. 4A is a flowchart showing an image forming operation.
Figure 4B:
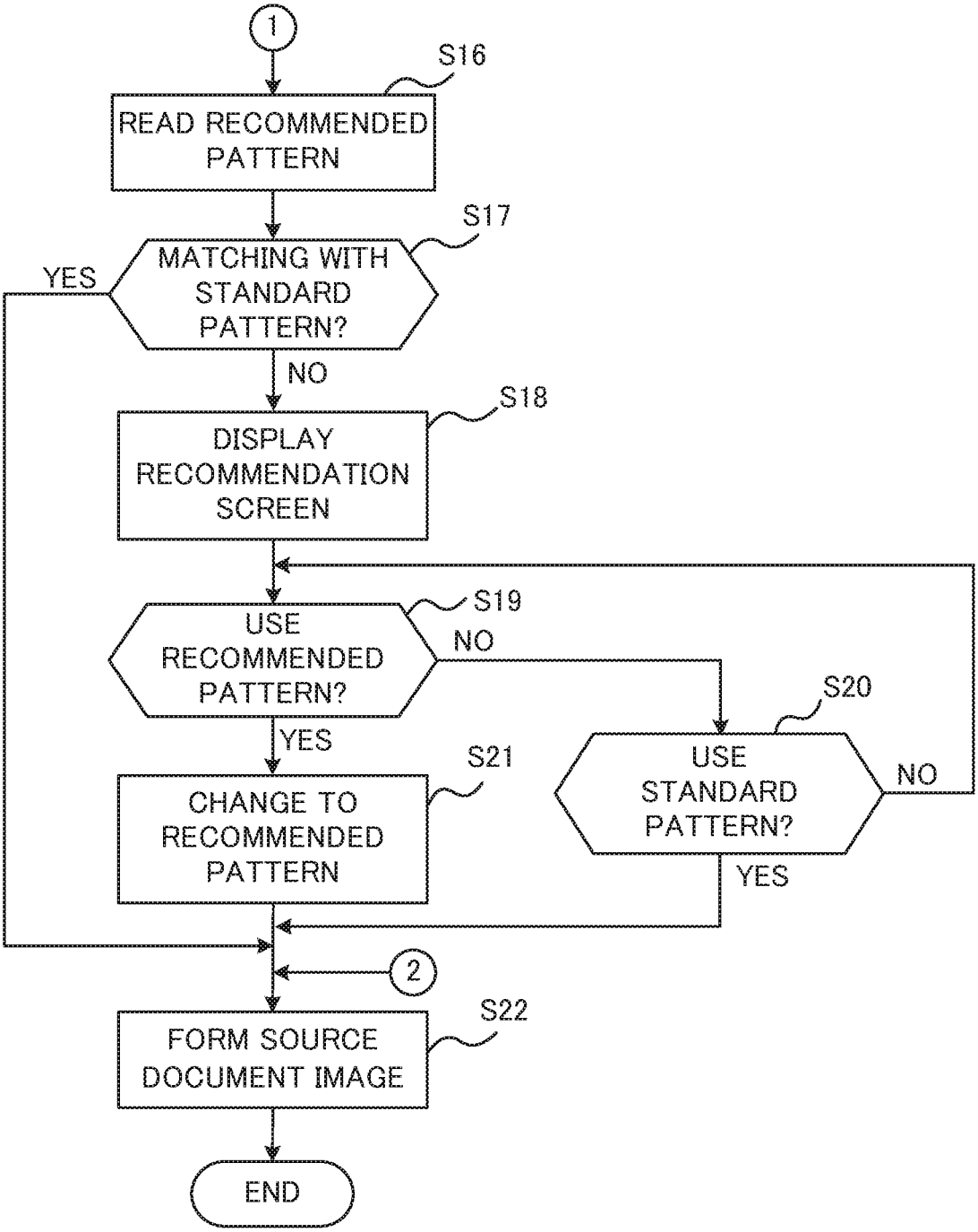
FIG. 4B is a flowchart showing an image forming operation subsequent to FIG. 4A.

Hereunder, an operation of the image forming apparatus 1 according to this embodiment will be described. FIG. 4A and FIG. 4B are flowcharts each showing the process of the image forming operation. It will be assumed that the power of the image forming apparatus 1 has been turned on, and that the user has inputted an instruction to perform the copying operation, through the touch panel 16B. Upon receipt of this instruction through the touch panel 16B, that controller 10 causes the display device 15 to display a setup screen for specifying the detail of the copying operation.

(1) When See-Through Prevention is Executed (1-1) When Edge Binding is Executed

Upon confirming the setup screen, the user inputs instructions to specify the detail of the copying operation, through the operation device 16. In this example, it will be assumed that the user inputs the instruction to designate the paper cassette 142A as the source of the recording sheet P, and the instruction to set the number of sets of the copies to be printed to ten sets. It will also be assumed that the user inputs the instruction to perform the see-through prevention operation, to form the see-through prevention image on the back face of the recording sheet P, and the instruction to perform the edge binding operation. Further, the user inputs the instruction to discharge the recording sheet P with the back face exposed (hereinafter, "face-down orientation").

Since the instruction to perform the edge binding operation has been inputted, the controller 10 sets the destination of the recording sheet P to the second output tray 306. The controller 10 also sets the page on which the see-through prevention image is to be formed (hereinafter, "printing page"), and the area in which the see-through prevention image is to be formed (hereinafter, "printing area"), to "all pages" and "all over" respectively, and sets the pattern for forming the see-through prevention image to the second pattern 34, which is specified as a standard pattern in advance. The controller 10 stores the mentioned detail of the setting in the HDD 18.

After inputting the mentioned instructions, the user places a plurality of recording sheets P on the paper cassette 142A, and also places a plurality of source documents on the document table 4A of the document feeding device 4. After placing the recording sheets P and the source documents, the user presses the start key 16A, to start the copying operation. Upon detecting that the start key 16A has been pressed, the controller 10 starts the image forming operation.

Referring to FIG. 4A, to perform the image forming operation, the controller 10 causes the image reading device 11 to read the respective images of the source documents, sequentially transported by the document feeding device 4, and generate the image data composed of a plurality of pages (step S11). After the generation of the image data, the controller 10 decides that the instruction to perform the see-through prevention operation, and the instruction to perform the edge binding operation have been received (YES at step 12 and step 13), according to the detail stored in the HDD 18. The controller then sets the printing page of the see-through prevention image to "last page", corresponding to the recording sheet P to be bound last by the binding device 320, and changes the setting of the printing page stored in the HDD 18, from "all pages" to "last page only" (step S14).

After changing the setting, the controller 10 identifies the illumination color around the image forming apparatus 1, on the basis of the value of the color temperature outputted from the detecting device 17, and the illumination color information stored in the HDD 18 (step S15). It is assumed that, at this point, a fluorescent light of the daylight color is turned on above the image forming apparatus 1. The value of the color temperature outputted from the detecting device 17 is, for example, 6000 K, on the basis of which the controller 10 identifies the illumination color as "daylight color", at step S15.

Referring to FIG. 4B, after identifying the illumination color the controller 10 reads out the first pattern 32 from the recommended pattern information stored in the HDD 18, as the recommended pattern associated with the "daylight color", which is the illumination color identified (step S16). Upon reading out the recommended pattern, the controller 10 decides that the first pattern 32, read out as the recommended pattern, is not in accordance with the standard pattern stored in the HDD 18 (NO at step S17), and causes the display device 15 to display a recommendation screen for showing the recommended pattern (step S18).

Figure 5:
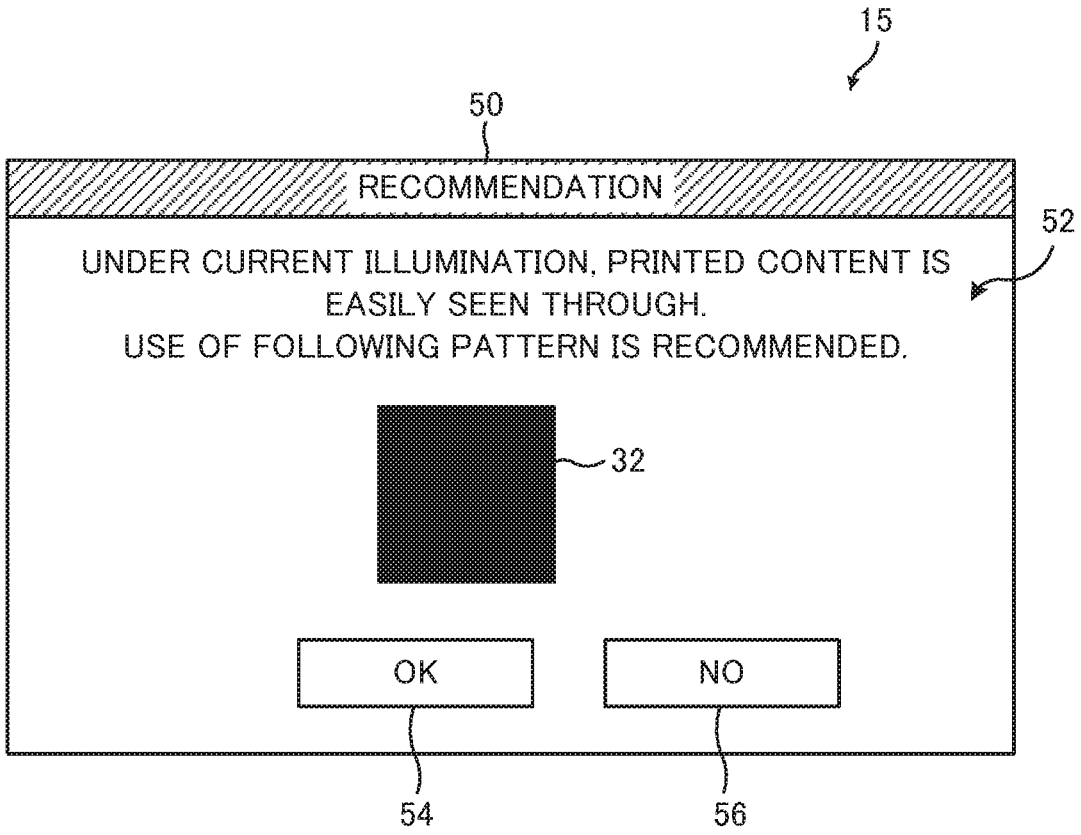
FIG. 5 is a schematic drawing showing an example of a recommendation screen.

FIG. 5 illustrates an example of the recommendation screen. As shown in FIG. 5, the controller 10 generates a recommendation screen 50 including such a message 52 as "Under current illumination, printed content is easily seen through. Use of following pattern is recommended", the first pattern 32 read out as the recommended pattern, a soft key 54 for instructing the use of the recommended pattern, and a soft key 56 for instructing the use of the standard pattern, and causes the display device 15 to display the recommendation screen 50 (step S18). After the recommendation screen 50 is displayed, the controller 10 stands by for a touch operation to be performed by the user on the key 54 or key 56, through the touch panel 16B (NO at step S19, NO at step S20).

Here, in the case where, for example, a fluorescent light of the incandescent light bulb color is turned on above the image forming apparatus 1, and the value of the color temperature outputted from the detecting device 17 is 3000 K, the controller 10 identifies the illumination color as "incandescent light bulb color" (step S15), and reads out the third pattern 36 as the recommended pattern associated with the incandescent light bulb color (step S16). Further, the controller 10 decides that the third pattern 36 read out as above is not in accordance with the standard pattern stored in the HDD 18 (NO at step S17), and causes the display device 15 to display the recommendation screen (step S18).

Figure 6:
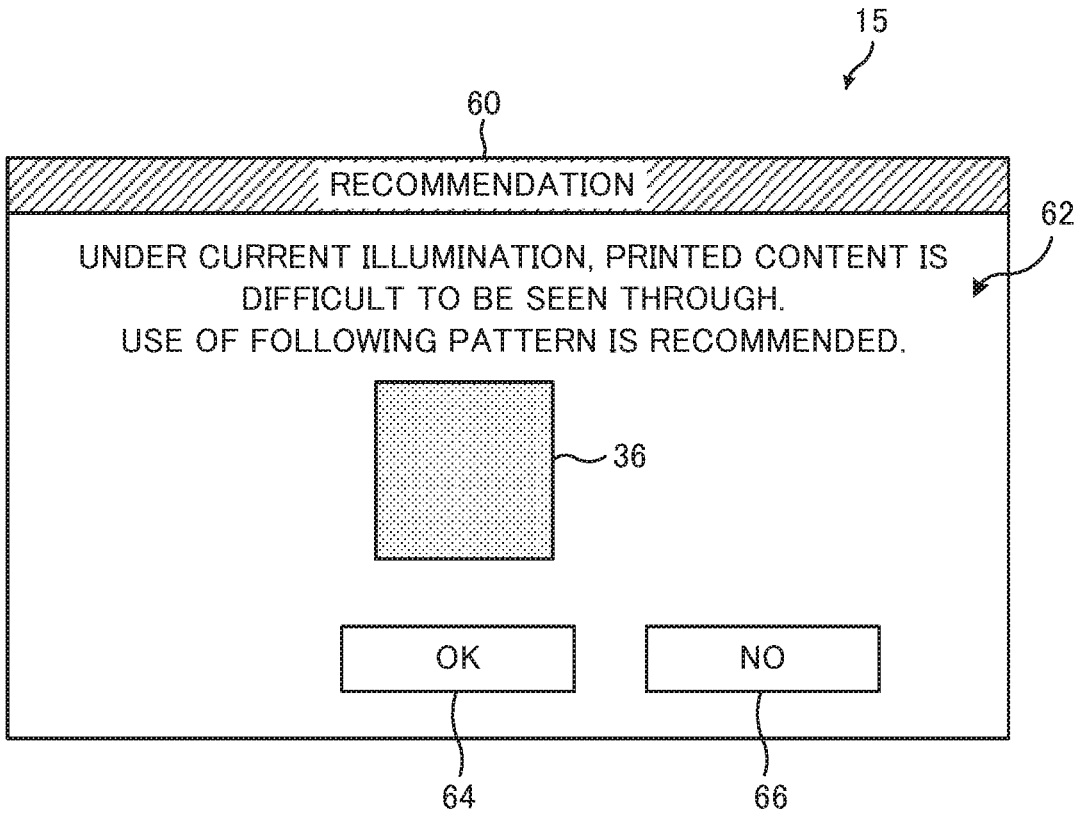
FIG. 6 is a schematic drawing showing another example of the recommendation screen.

FIG. 6 illustrates another example of the recommendation screen. As shown in FIG. 6, the controller 10 generates a recommendation screen 60 including such a message 52 as "Under current illumination, printed content is difficult to be seen through. Use of following pattern is recommended", the third pattern 36 read out as the recommended pattern, a soft key 64 for instructing the use of the recommended pattern, and a soft key 66 for instructing the use of the standard pattern, and causes the display device 15 to display the recommendation screen 60 (step S18). After the recommendation screen 60 is displayed, the controller 10 stands by for a touch operation to be performed by the user on the key 64 or key 66, through the touch panel 16B (NO at step S19, NO at step S20).

Hereunder, the operation to be performed when the recommendation screen 50 is displayed by the display device 15 will be described. The operation to be performed when the recommendation screen 60 is displayed by the display device 15 is the same as the following description, except that the recommended pattern is the third pattern 36.

(1-1-1) When Using Recommended Pattern

In view of the recommendation screen 50, the user touches the key 54. The controller 10 detects the touch operation on the key 54 through the touch panel 16B, thereby receiving the instruction to use the recommended pattern (YES at step S19), and changes the setting stored in the HDD 18, with respect to the pattern for forming the see-through prevention image, from the second pattern 34 to the first pattern 32 which is the recommended pattern (step S21).

After changing the setting, the controller 10 causes the image forming device 12 to form the source document image and the see-through prevention image on the recording sheet P, according to the detail stored in the HDD 18 (step S22), as described hereunder. The controller 10 causes the image forming device 12 to form the respective source document images, sequentially in the order of the pages, based on the image data generated by the image reading device 11, on the front face of the recording sheets P delivered one by one from the paper cassette 142A by the paper feeding device 14. The controller also causes the image forming device 12 to form the see-through prevention image of the first pattern 32, all over the back face of the recording sheet P on which the source document image of the last page has been printed.

The plurality of recording sheets P from the first to the last page, on each of which the image has been printed, are transported by the first transport mechanism 19 to the post-processing device 3, and then transported by the second transport mechanism to the processing tray 307. The recording sheets P transported to the processing tray 307 are temporarily accumulated on the processing tray 307, with the respective leading edges aligned with each other. The controller 10 causes the binding device 320 to bind the edge portion of the recording sheets P stacked on the processing tray 307. Here, the recording sheet P on which the see-through prevention image has been formed corresponds to the last page of the recording sheets P bound by the binding device 320.

The bundle of the recording sheets P that has undergone the edge binding operation is transported by the second transport mechanism to the second output tray 306, and discharged thereto, with the back face of the last page of the recording sheets P exposed. The controller 10 repeats the foregoing operation nine times, to thereby create the first to the tenth sets of the printed materials.

(1-1-2) When Using Standard Pattern

In view of the recommendation screen 50, the user touches the key 56. The controller 10 detects the touch operation on the key 56 through the touch panel 16B, thereby receiving the instruction to use the standard pattern (YES at step S20), and performs the operation of step S22 as described hereunder, without performing the operation of step S21.

The controller 10 causes the image forming device 12 to form the respective source document images, sequentially in the order of the pages, on the front face of the recording sheets P delivered one by one from the paper cassette 142A by the paper feeding device 14. The controller also causes the image forming device 12 to form the see-through prevention image of the second pattern 34, all over the back face of the recording sheet P on which the source document image of the last page has been printed. The plurality of recording sheets P from the first to the last page, on each of which the image has been printed, undergo the edge binding operation of the binding device 320 as described above, and are discharged to the second output tray 306 by the second transport mechanism, in the form of the bundle of the recording sheets P. The controller 10 repeats the foregoing operation nine times, to thereby create the first to the tenth sets of the printed materials.

(1-2) When Performing Shifted Discharge Operation

In view of the setup screen, the user inputs the instructions to specify the detail of the copying operation, through the operation device 16. In this example, it will be assumed that the user inputs the instruction to designate the paper cassette 142A and the paper cassette 142B as the source of the recording sheet P, and the instruction to set the number of sets of the copies to be printed to ten sets. It will also be assumed that the user inputs the instruction to perform the see-through prevention operation, and the instruction to perform a shifted discharge operation. Here, the shifted discharge operation refers to changing the orientation of the long sides of the recording sheets P by 90 degrees with respect to each of the sets, to thereby discharge the recording sheets P to the first output tray 7, such that the position of each set of the recording sheets P is shifted from each other. Further, the user inputs the instruction to discharge the recording sheet P in the face-down orientation, but does not input the instruction to perform the post-processing.

Since the instruction to cause the post-processing device 3 to perform the post-processing has not been received, the controller 10 designates the first output tray 7 as the destination of the recording sheet P. In addition, since the instruction to perform the see-through prevention operation has been received, the controller 10 sets the printing page and the printing area for the see-through prevention image to the standard setting, and sets the pattern for forming the see-through prevention image to the standard pattern. Then the controller 10 stores the mentioned detail of the setting in the HDD 18.

After inputting the mentioned instructions, the user places a plurality of recording sheets P, on each of the paper cassette 142A and the paper cassette 142B. Here, it is assumed that the recording sheets P are placed on the paper cassette 142A and the paper cassette 142B, such that the long sides of the recording sheets P on the paper cassette 142A and the long sides of the recording sheets P on the paper cassette 142B become orthogonal to each other. The user also places a plurality of source documents on the document table 4A of the document feeding device 4, and presses the start key 16A.

Referring again to FIG. 4A, upon detecting that the start key 16A has been pressed, the controller 10 performs the operation of step S11 as described earlier. After performing the operation of step S11, the controller 10 decides, according to the detail stored in the HDD 18, that the instruction to perform the see-through prevention has been received (YES at step 12), and that the instruction to perform the edge binding operation has not been received (NO at step S13).

The controller 10 also decides that the instruction to perform the shifted discharge operation has been received (YES at step S23). Then the controller 10 sets the printing page of the see-through prevention image to "last page" corresponding to the recording sheet P discharged last to the first output tray 7 in each of the sets, and changes the setting of the printing page stored in the HDD 18 from "all pages" to "last page only". Further, the controller 10 sets the printing area for the see-through prevention image to "predetermined region", and changes the setting of the printing area stored in the HDD 18 from "all over" to "predetermined region" (step S24).

Figure 7A:
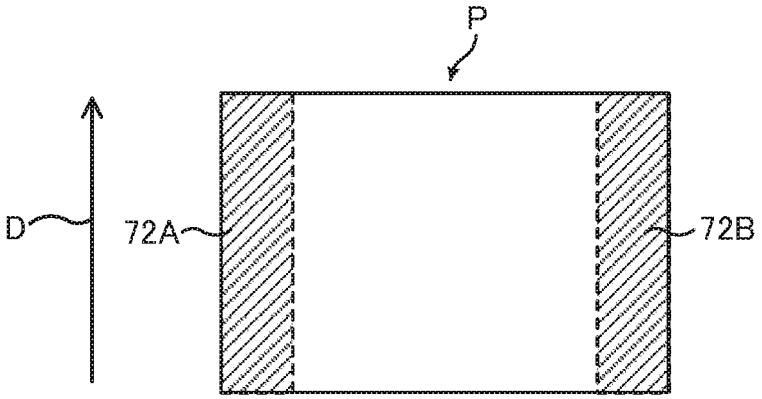
FIG. 7A is a schematic drawing showing an example of a predetermined printing area for a see-through prevention image.
Figure 7B:
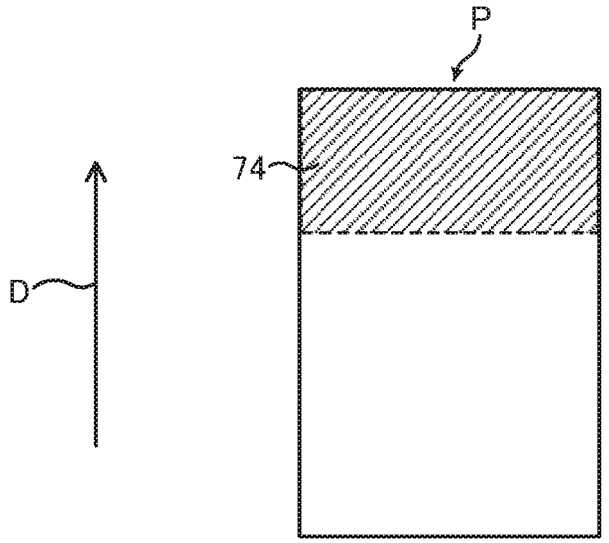
FIG. 7B is a schematic drawing showing another example of the predetermined printing area for a see-through prevention image.
Figure 7C:
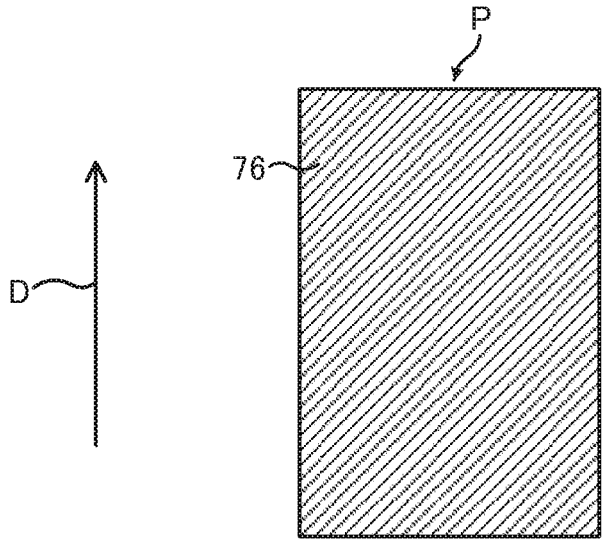
FIG. 7C is a schematic drawing showing still another example of the predetermined printing area for a see-through prevention image.

FIGS. 7A to 7C each illustrate an example of the predetermined region representing the printing area for the see-through prevention image. Referring to FIG. 7A, the printed materials in the odd-numbered sets of the recording sheets P are discharged to the first output tray 7, such that the short sides of the recording sheet are oriented in the same direction as a discharge direction D. With respect to the printed materials in the odd-numbered sets, the edge portions 72A and 72B on the respective sides in the longitudinal direction, on the back face of the recording sheet P to be discharged last, which are the regions that do not overlap with the recording sheets of the even-numbered sets to be discharged immediately thereafter, are specified in advance as the printing area for the see-through prevention image.

Referring to FIG. 7B, the printed materials in the even-numbered sets of the recording sheets P are discharged to the first output tray 7, such that the long sides of the recording sheet are oriented in the same direction as the discharge direction D. With respect to the printed materials in the even-numbered sets, an edge portion 74 on one side in the longitudinal direction, on the back face of the recording sheet P to be discharged last, which is the region that does not overlap with the recording sheets of the odd-numbered sets to be discharged immediately thereafter, is specified in advance as the printing area for the see-through prevention image. Referring to FIG. 7C, with respect to the printed materials in the last set, the entire region 76 of the recording sheet P to be discharged last is specified in advance as the printing area for the see-through prevention image, irrespective of whether the number of sets is an even number or an odd number.

After changing the setting, the controller 10 performs the operation of step S15 as described above. It is assumed that, at this point, a fluorescent light of the neutral white is turned on above the image forming apparatus 1. The value of the color temperature outputted from the detecting device 17 is, for example, 5000 K, on the basis of which the controller 10 identifies the illumination color as "neutral white", at step S15.

Referring again to FIG. 4B, after identifying the illumination color the controller 10 reads out the second pattern 34 from the recommended pattern information stored in the HDD 18, as the recommended pattern associated with the "neutral white" (step S16). Upon reading out the recommended pattern, the controller 10 decides that the second pattern 34, read out as above, is in accordance with the standard pattern stored in the HDD 18 (YES at step S17), and performs the operation of step S22 as described hereunder, without performing the operation of step S18 to step S21.

The controller 10 causes the image forming device 12 to form the respective source document images, sequentially in the order of the pages, on the front face of the recording sheets P delivered one by one from the paper cassette 142A by the paper feeding device 14. The controller also causes the image forming device 12 to form the see-through prevention image of the second pattern 34, on the predetermined regions 72A and 72B on the back face of the recording sheet P, on the front face of which the source document image of the last page has been printed. The plurality of recording sheets P from the first to the last page, on each of which the image has been printed, are transported by the first transport mechanism 19 to the first output tray 7, and discharged thereto as the printed materials of the first set, with the back face of the last page of the recording sheets P exposed.

The controller 10 then switches the source of the recording sheet P from the paper cassette 142A to the paper cassette 142B, and causes the image forming device 12 to form the respective source document images, sequentially in the order of the pages, on the front face of the recording sheets P delivered one by one from the paper cassette 142B by the paper feeding device 14. The controller also causes the image forming device 12 to form the see-through prevention image of the second pattern 34, on the predetermined region 74 on the back face of the recording sheet P, on the front page of which the source document image of the last page has been printed. The plurality of recording sheets P from the first to the last page, on each of which the image has been printed, are transported by the first transport mechanism 19 to the first output tray 7, and discharged thereto as the printed materials of the second set, with the back face of the last page of the recording sheets P exposed.

At this point, the printed materials of the second set are discharged so as to be stacked on the printed materials of the first set, such that the long sides of the recording sheets P of the second sets are orthogonally oriented with respect to the long sides of the recording sheets P of the first set. Further, the controller 10 alternately repeats the operation to create the printed materials of the first set, and the operation to create the printed materials of the second set, thereby creating the printed materials of the first to the ninth sets.

After creating the printed materials of the ninth set, the controller 10 switches the source of the recording sheet P from the paper cassette 142A to the paper cassette 142B, and causes the image forming device 12 to form the respective source document images, sequentially in the order of the pages, on the front face of the recording sheets P delivered one by one from the paper cassette 142B by the paper feeding device 14. The controller also causes the image forming device 12 to form the see-through prevention image of the second pattern 34, all over the back face of the recording sheet P, on the front page of which the source document image of the last page has been printed. The plurality of recording sheets P from the first to the last page, on each of which the image has been printed, are transported by the first transport mechanism 19 to the first output tray 7, and discharged thereto as the printed materials of the tenth set, with the back face of the last page of the recording sheets P exposed.

As described above, the controller 10 performs the shifted discharge operation, by causing the paper feeding device 14 to deliver the recording sheets P for each of the sets, alternately from the paper cassette 142A and the paper cassette 142B, on which the recording sheets P are stacked in different orientation, and causing the first transport mechanism 19 to transport the recording sheets P on each of which the image has been printed to the first output tray 7, and discharge thereto. Here, the paper feeding device 14 and the first transport mechanism 19 exemplify the discharge mechanism in What is claimed is.

(1-3) When Skipping Edge Binding Operation and Shifted Discharge Operation

In view of the setup screen, the user inputs the instructions to specify the detail of the copying operation, through the operation device 16. In this example, it will be assumed that the user inputs the instruction to designate the paper cassette 142A as the source of the recording sheet P, and the instruction to set the number of sets of the copies to be printed to one set. It will also be assumed that the user inputs the instruction to perform the see-through prevention operation, and the instruction to discharge the recording sheet P in the face-down orientation. However, the user does not input the instruction to perform the post-processing and the shifted discharge operation.

Since the instruction to perform the post-processing has not been received, the controller 10 designates the first output tray 7 as the destination of the recording sheet P. In addition, since the instruction to perform the see-through prevention operation has been received, the controller 10 sets the printing page and the printing area for the see-through prevention image to the standard setting, and sets the pattern for forming the see-through prevention image to the standard pattern. Then the controller 10 stores the mentioned detail of the setting in the HDD 18.

After inputting the mentioned instructions, the user places a plurality of recording sheets P on the paper cassette 142A, and also places a plurality of source documents on the document table 4A of the document feeding device 4. After placing the recording sheets P and the source documents, the user presses the start key 16A. Referring again to FIG. 4A, upon detecting that the start key 16A has been pressed, the controller 10 performs the operation of step S11 as described above. After performing the operation of step S11, the controller 10 decides that the instruction to perform the see-through prevention operation has been received (YES at step 12), and that the instruction to perform the edge binding operation has not been received (NO at step S13), according to the detail of the setting stored in the HDD 18.

The controller 10 also decides that the instruction to perform the shifted discharge operation has not been received (NO at step S23), and performs the operation of step S22 as described hereunder. The controller 10 causes the image forming device 12 to form the respective source document images, sequentially in the order of the pages, on the front face of the recording sheets P delivered one by one from the paper cassette 142A by the paper feeding device 14. The controller also causes the image forming device 12 to form the see-through prevention image of the second pattern 34, all over the back face of the recording sheets P of all the pages, on each of which the source document image has been printed. The plurality of recording sheets P from the first to the last page, on each of which the image has been printed, are transported by the first transport mechanism 19 to the first output tray 7, and discharged thereto as the printed materials of the first set, with the back face of the recording sheets P discharged last exposed.

(2) When Skipping See-Through Prevention Operation

In view of the setup screen, the user inputs the instructions to specify the detail of the copying operation, through the operation device 16. In this example, it will be assumed that the user inputs the instruction to designate the paper cassette 142C as the source of the recording sheet P, and the instruction to set the number of sets of the copies to be printed to one set. It will also be assumed that the user inputs the instruction to discharge the recording sheet P in the face-down orientation. However, the user does not input the instruction to perform the see-through prevention operation, the post-processing, and the shifted discharge operation.

Since the instruction to perform the post-processing has not been received, the controller 10 designates the first output tray 7 as the destination of the recording sheet P. Since the instruction to perform the see-through prevention operation has not been received, the controller 10 does not specify the printing page and the printing area for the see-through prevention image, and the pattern for forming the see-through prevention image. The controller 10 stores the mentioned detail of the setting, in the HDD 18.

After inputting the mentioned instructions, the user places a plurality of recording sheets P on the paper cassette 142C, and also places a plurality of source documents on the document table 4A of the document feeding device 4. After placing the recording sheets P and the source documents, the user presses the start key 16A. Referring again to FIG. 4A, upon detecting that the start key 16A has been pressed, the controller 10 performs the operation of step S11 as described above. After performing the operation of step S11, the controller 10 decides that the instruction to perform the see-through prevention operation has not been received (NO at step 12), and performs the operation of step S22 as described hereunder.

The controller 10 causes the image forming device 12 to form the respective source document images, sequentially in the order of the pages, on the front face of the recording sheets P delivered one by one from the paper cassette 142C by the paper feeding device 14, but skips the operation to form the see-through prevention image. The plurality of recording sheets P from the first to the last page, on each of which the image has been printed, are transported by the first transport mechanism 19 to the first output tray 7, and discharged thereto as the printed materials of the first set, with the back face of the recording sheets P discharge last exposed.

Now, when a plurality of recording sheets, on each of which a source document image has been printed, are stacked on each other, the source document images are difficult to be seen from the opposite side of the recording sheet, except the source document image printed on the uppermost one of the stacked recording sheets. With the foregoing first technique and second technique that are known, however, the see-through prevention image is also printed on each of a plurality of recording sheets, when the source document images are printed on a plurality of recording sheets, and therefore the toner may be wastefully consumed.

With the arrangement according to the foregoing embodiment, in contrast, when the instruction to form the source document image on the front face of a plurality of recording sheets P is received through the operation device 16, the controller 10 causes the image forming device 12 to form the source document image on the front face of the plurality of recording sheets P, designates the recording sheet P on which the see-through prevention image is to be formed, out of the plurality of recording sheets P, and causes the image forming device 12 to form the see-through prevention image, only on the back face of the designated recording sheet P.

Since the see-through prevention image is thus formed only on the back face of the recording sheet P designated out of the plurality of recording sheets P, the consumption of the toner can be reduced compared with the case of forming the see-through prevention image on all the recording sheets P on each of which the source document image has been printed, and yet the source document image can be effectively hidden by the see-through prevention image. Here, the front face corresponds to the first face in What is claimed is, and the back face corresponds to the second face in What is claimed is.

According to the foregoing embodiment, when the instruction to perform the edge binding operation is also received through the operation device 16, the controller 10 designates the recording sheet P to be bound last by the binding device 320 as the recording sheet P on which the see-through prevention image is to be formed. Therefore, when the plurality of recording sheets P having the source document image formed thereon are bound, and the bundle of the recording sheets P is carried by the user with the front face opposed to the user, the see-through prevention image is formed only on the recording sheet P, the source document image on which may be seen through from the opposite side by a third party. Consequently, the toner consumption can be reduced, and yet the source document image can be securely hidden by the see-through prevention image.

According to the foregoing embodiment, when the instruction to discharge the recording sheet P with the back face thereof exposed, the controller 10 designates the recording sheet P to be discharge last to the first output tray 7, out of the plurality of recording sheet P, as the recording sheet P on which the see-through prevention image is to be formed. Therefore, when the plurality of recording sheets P are discharged to the first output tray 7 in the stacked state, the see-through prevention image is formed only on the recording sheet P, the source document image on which may be seen through from the opposite side. Consequently, the toner consumption can be reduced, and yet the source document image can be securely hidden by the see-through prevention image.

According to the foregoing embodiment, when the instruction to perform the shifted discharge operation is also received through the operation device 16, the controller 10 designates the recording sheet P to be discharged last to the first output tray 7 as the recording sheet on which the see-through prevention image is to be formed, with respect to each of the sets, and causes the image forming device 12 to form the see-through prevention image on the back face of the designated recording sheet P, on the predetermined region that does not overlap with other recording sheets P. Therefore, when the printed materials are discharged to the first output tray 7 such that the orientation of each set of the recording sheets is shifted, the see-through prevention image is formed only on the region where the source document image may be seen through from the opposite side. Consequently, the toner consumption can be reduced, and yet the source document image can be securely hidden by the see-through prevention image.

Further, according to the foregoing embodiment, the controller 10 identifies the illumination color on the basis of the value of the color temperature detected by the detecting device 17, and the illumination color information, reads out the recommended pattern associated with the identified illumination color from the HDD 18, and causes the image forming device 12 to form the see-through prevention image of the recommended pattern, on the back face of the designated recording sheet P. Therefore, a suitable see-through prevention image is formed depending on the illumination color around the image forming apparatus 1, which leads to efficient reduction in toner consumption, while allowing the source document image to be securely hidden by the see-through prevention image.

Further, according to the foregoing embodiment, when the recommended pattern read out as above does not accord with the standard pattern, the controller 10 causes the display device 15 to display the recommended pattern, and when the instruction to use the displayed recommended pattern is received through the operation device 16, the controller 10 causes the image forming device 12 to form the see-through prevention image of the recommended pattern, on the back face of the designated recording sheet P. When the instruction to use the standard pattern is received through the operation device 16, the controller 10 causes the image forming device 12 to form the see-through prevention image of the standard pattern, on the back face of the designated recording sheet P. Therefore, for example when the user intends to use the printed material in a location where the image forming apparatus 1 is not installed, the user can select a suitable see-through prevention image depending on the purpose of use of the printed material, which leads to improved user-friendliness.

Variations

In the foregoing embodiment, the controller 10 causes the paper feeding device 14 and the first transport mechanism 19 to perform the shifted discharge operation, with respect to a predetermined unit of the printed material, namely each of the sets. However, the disclosure is not limited to such an arrangement. For example, the controller 10 may cause the paper feeding device 14 and the first transport mechanism 19 to perform the shifted discharge operation, with respect to each page, as the predetermined unit of the printed material.

In the foregoing embodiment, the controller 10 performs the shifted discharge operation by changing the orientation of the long sides of the recording sheet P with respect to each of the sets. However, the disclosure is not limited to such an arrangement. For example, the image forming apparatus 1 may be provided with a plurality of output trays, and the controller 10 may perform the shifted discharge operation by discharging each set of the recording sheets P separately to one of the plurality of output trays. In this case, at step S24, the controller 10 changes the setting of the printing page stored in the HDD 18 from "all pages" to "last page only", but keeps the setting of the printing area unchanged from "all over".

Although the controller 10 is configured to perform the image forming operation when executing the copying function, in the foregoing embodiment, the disclosure is not limited such a configuration. For example, the controller 10 may perform the image forming operation, when executing the printing function including forming the source document image, on the basis of the image data transmitted from the information processing apparatus 24 and received through the communication device 23. In this case, the controller 10 skips the operation of step S11, and performs the operation of step S12 to step S24.

In the foregoing embodiment, the controller 10 is only configured to form the see-through prevention image on the back face of the recording sheet P, as the method of see-through prevention. However, the disclosure is not limited such a configuration. For example, the controller 10 may be further configured to lighten the printing density of the source document image, as the method of see-through prevention. In this case, the controller 10 may be configured to set the printing density to a first predetermined density, when the illumination color is the incandescent light bulb color, to a second predetermined density lighter than the first predetermined density, when the illumination color is the neutral white, and to a third predetermined density lighter than the second predetermined density, when the illumination color is the daylight color.

In the foregoing embodiment, the controller 10 performs the shifted discharge operation by causing the paper feeding device 14 and the first transport mechanism 19 to change the orientation of the long sides of the recording sheet P by 90 degrees, with respect to each of the sets. However, the disclosure is not limited such a configuration. For example, the controller 10 may cause the paper feeding device 14 and the first transport mechanism 19 to shift, when discharging the recording sheets P, the positions of the respective sets of the recording sheets P in the discharging direction. In this case also, the region of the back face of the recording sheet P to be discharged last in each set, not overlapping with the recording sheets of the set to be discharged immediately thereafter, is specified in advance as the printing area for the see-through prevention image. Regarding the printed materials of the last set, the entire region of the recording sheet P to be discharged last is specified in advance as the printing area for the see-through prevention image.

Further, although the image forming device 12 is configured to form an image on the recording sheet, in the foregoing embodiment, the disclosure is not limited to such a configuration. The image forming device 12 may form an image on a different recording medium, other than the recording sheet. For example, an overhead projector (OHP) sheet may be employed, to form an image.

In the foregoing embodiment, further, when the instruction to perform the see-through prevention operation is received, but the instruction to perform the post-processing, and the instruction to perform the shifted discharge operation are not received, the controller 10 causes the image forming device 12 to form the see-through prevention image of the second pattern 34 all over the back face of the recording sheets P of all pages, on the front face of which the source document image has been formed. However, the disclosure is not limited to such an arrangement. For example, the controller 10 may cause the image forming device 12 to form the see-through prevention image of the second pattern 34, all over the back face of only the recording sheets P of the last page, on the front face of which the source document image has been formed.

The disclosure may be modified in various manners, without limitation to the foregoing embodiments. For example, although the color MFP is taken up in the foregoing embodiments as an example of the image forming apparatus according to the disclosure, the disclosure is also applicable to various other image forming apparatuses, such as a monochrome MFP, a printer, a copier, and a facsimile machine.

Further, the configurations and processings described in the foregoing embodiments with reference to FIG. 1 and FIG. 7C are merely exemplary, and in no way intended to limit the disclosure to those configurations and processings.

While the present disclosure has been described in detail with reference to the embodiments thereof, it would be apparent to those skilled in the art the various changes and modifications may be made therein within the scope defined by the appended claims.

What is claimed is:

1. An image forming apparatus comprising:

an input device for inputting an instruction of a user;

an image forming device that forms an image on a recording medium; and a control device including a processor, and configured to act, when the processor executes a control program, as a controller that:

upon receipt of an instruction to form a source document image on a first face of a plurality of recording media through the input device, causes the image forming device to form the source document image on the first face of the plurality of recording media;

designates a recording medium on which a see-through prevention image, constituted of a predetermined pattern, is to be formed, out of the plurality of recording media; and causes the image forming device to form the see-through prevention image only on a second face, opposite to the first face, of the recording medium designated.

2. The image forming apparatus according to claim 1, further comprising a binding device that binds the plurality of recording media, wherein, when an instruction to bind the plurality of recording media by the binding device is received through the input device, the controller designates a recording medium to be bound last by the binding device as the recording medium on which the see-through prevention image is to be formed.

3. The image forming apparatus according to claim 1, further comprising:

an output tray to which the recording medium on which the image has been formed is discharged; and a discharge mechanism that discharges the recording medium to the output tray, wherein, when an instruction to discharge the recording medium with the second face of the recording medium exposed is received through the input device, the controller designates a recording medium to be discharged last to the output tray out of the plurality of recording media, as the recording medium on which the see-through prevention image is to be formed.

4. The image forming apparatus according to claim 3, wherein the discharge mechanism is configured to discharge the recording medium to the output tray, such that positions at which the recording medium is to be discharged are shifted from each other, with respect to each of a predetermined unit of the recording medium, and when an instruction to perform a shifted discharge operation, to discharge the recording medium to the shifted position, is further received through the input device, the controller designates the recording medium to be discharged last in the predetermined unit as the recording medium on which the see-through prevention image is to be formed, with respect to each predetermined unit, and causes the image forming device to form the see-through prevention image on a region of the second face of the recording medium designated, the region being specified in advance as a region not overlapping with other recording media.

5. The image forming apparatus according to claim 1, further comprising:

a detecting device that detects an illumination color around the image forming apparatus; and a storage device storing in advance the illumination color and a recommended pattern in association with each other, the recommended pattern being a pattern for constituting the see-through prevention image with respect to the illumination color, wherein the controller reads out the recommended pattern associated with the illumination color detected by the detecting device from the storage device, and causes the image forming device to form the see-through prevention image constituted of the recommended pattern that has been read out, on the second face of the recording medium designated.

6. The image forming apparatus according to claim 5, further comprising a display device, wherein the controller is configured to:

cause the display device to display the recommended pattern, when the recommended pattern that has been read out is different from a predetermined standard pattern for forming the see-through prevention image;

cause the image forming device to form the see-through prevention image constituted of the recommended pattern on the second face of the recording medium designated, when an instruction to form the see-through prevention image constituted of the recommended pattern is received through the input device; and cause the image forming device to form the see-through prevention image constituted of the standard pattern on the second face of the recording medium designated, when an instruction to form the see-through prevention image constituted of the standard pattern is received through the input device.

7. The image forming apparatus according to claim 6, wherein, when the recommended pattern that has been read out accords with the predetermined standard pattern for forming the see-through prevention image, the controller causes the image forming device to form the see-through prevention image constituted of the standard pattern on the second face of the recording medium designated, without causing the display device to display the recommended pattern.

* * * * *